United States Patent [19]

Zock, Jr.

[11] Patent Number: 4,910,883

[45] Date of Patent: Mar. 27, 1990

[54] CRAMPTON HAVING INTERCHANGEABLE PICK ELEMENTS

[76] Inventor: Robert A. Zock, Jr., 65 Highland St., Ashland, N.H. 03217

[21] Appl. No.: 234,402

[22] Filed: Aug. 19, 1988

[51] Int. Cl.[4] ..... A43C 15/06

[52] U.S. Cl. ..... 36/7.6; 36/62; 36/114; 36/134

[58] Field of Search ..... 36/7.6, 7.7, 62, 64, 36/65, 66, 134, 114; 30/164.5, 164.6, 164.8

[56] References Cited

U.S. PATENT DOCUMENTS

| | | | |
|---|---|---|---|
| 145,656 | 12/1873 | Johnson et al. | 36/7.6 |
| 1,039,928 | 10/1912 | Gray | 36/7.6 |
| 1,837,730 | 12/1931 | Smith | 36/7.6 |
| 2,401,891 | 6/1946 | Smith | 36/62 |
| 3,229,389 | 8/1964 | Adams | 36/7.6 |
| 3,685,173 | 8/1972 | Piazza | 36/7.6 |
| 3,775,874 | 12/1973 | Bonneville | 36/67 |
| 4,286,396 | 9/1981 | Deacon | 36/62 |
| 4,299,037 | 11/1981 | Carey | 36/7.6 |
| 4,338,733 | 7/1982 | Frechin | 36/7.3 |
| 4,344,238 | 8/1982 | Peyser | 36/7.6 |
| 4,353,172 | 10/1982 | Bryant | 36/7.6 |
| 4,480,396 | 11/1984 | Lowe et al. | 36/7.6 |
| 4,620,375 | 11/1986 | Wallace | 36/7.6 |

FOREIGN PATENT DOCUMENTS

| | | | |
|---|---|---|---|
| 1112865 | 11/1981 | Canada | 36/134 |
| 233130 | 8/1987 | European Pat. Off. | 36/134 |
| 258603 | 3/1988 | European Pat. Off. | 36/114 |
| 2264044 | 7/1974 | Fed. Rep. of Germany | 36/7.6 |
| 1330099 | 5/1963 | France | 36/7.6 |
| 2106932 | 5/1972 | France | 36/7.6 |
| 656052 | 6/1986 | Switzerland | 36/134 |
| 1355812 | 6/1974 | United Kingdom | 36/7.6 |

OTHER PUBLICATIONS

International Mountain Equipment, P.O. Box 494, Main Street, North Conway, NY 03860 catalog, pp. 54–55.

*Primary Examiner*—James Kee Chi

*Attorney, Agent, or Firm*—Weingarten, Schurgin, Gagnebin & Hayes

[57] ABSTRACT

A crampon removably attached to a shoe having a plurality of teeth oriented in an angled, noncolinear fashion, such as on the faces of a polygon, on both a heel and toe portion of the crampon. The toe portion of the crampon further includes a plurality of slots which receive a plurality of pick elements selected from a variety of interchangeable pick elements. The variety of pick elements includes a double flat pick, a single reverse angle pick, a flanker pick, a tooth claw pick and a novel tubular pick. The crampon according to the present invention provides enhanced traction by inhibiting a skating action resulting from the substantially linearly disposed teeth of prior crampon designs, while providing a maximum flexibility by interchangeably receiving a variety of pick elements.

20 Claims, 1 Drawing Sheet

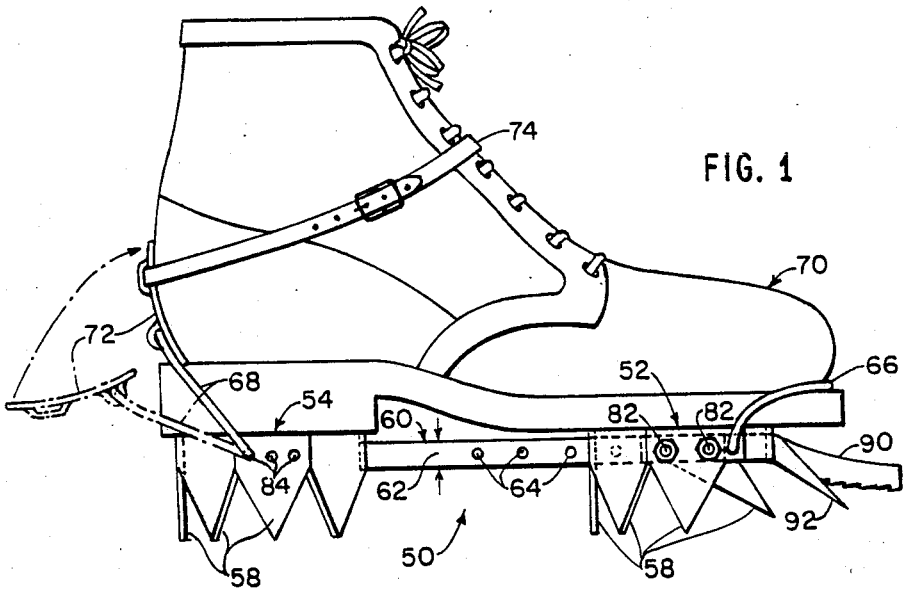
FIG. 1
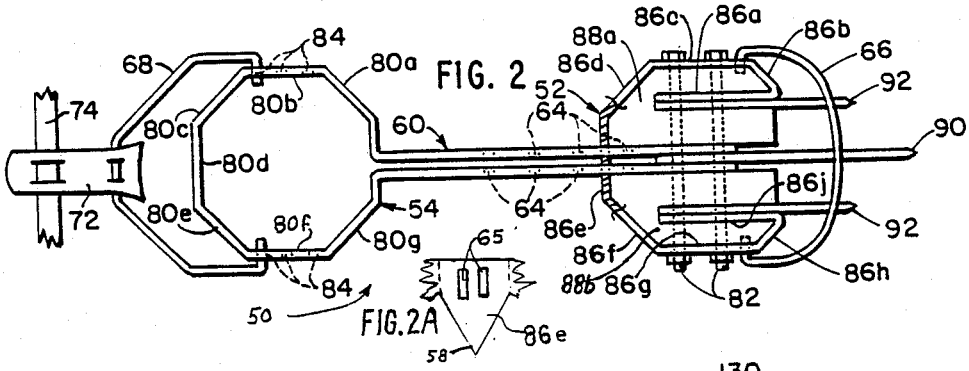
FIG. 2
FIG. 2A
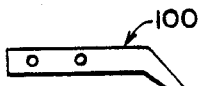
FIG. 3
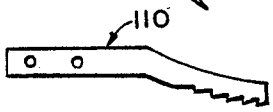
FIG. 4
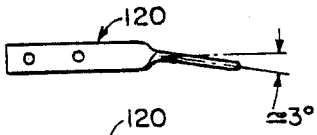
FIG. 5
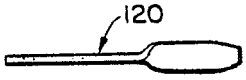
FIG. 6
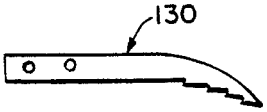
FIG. 7
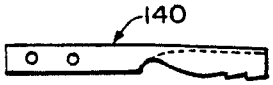
FIG. 8
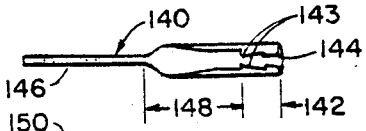
FIG. 9
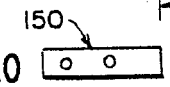
FIG. 10

CRAMPTON HAVING INTERCHANGEABLE PICK ELEMENTS

FIELD OF THE INVENTION

The present invention relates to traction attachments for shoes and, in particular, crampon devices for use in mountaineering to provide traction on slippery surfaces.

BACKGROUND OF THE INVENTION

Outdoor activities such as hiking, rock climbing and mountaineering, especially in the wintertime wherein surfaces are likely to become ice covered and extremely hazardous, present a significant problem to the safety of the participant. In order to negotiate such conditions, a removable crampon is used, which when attached to the base of the shoe, provides enhanced traction.

Previous crampon devices incorporate a number of teeth aligned in a substantially linear manner along the perimeter of the shoe sole. However, it is foreseeable, and to some mountaineers desirable to climb steeper pitches of terrain, to include vertical cliff formations, it is therefore also critical to maintain traction. Previous crampons, having the majority of teeth aligned in a colinear fashion will exhibit a "skating" effect on the ice surface as a result of the colinear alignment of the teeth. The skating effect, occurs primarily when either the toe or heel of the boot is facing down the slope of the terrain.

However, as more vertical terrain is encountered, the body becomes more contorted when attempting to maintain downward facing teeth in "12 point" contact with the ice surface. Consequently a "front pointing" technique utilizing picks protrude from the front of the crampon has been developed, enabling the wearer, with the use of one or two hand held ice axes, to step up the ice wall as one would climb a ladder. However, such picks are typically permanently affixed to the crampons, inhibiting the stride of the wearer when walking with the teeth contacting the flat surface, in the "12 point" technique. Furthermore, should any pick become broken, worn, or bent for any reason, the usefulness and safety of the crampon is compromised.

SUMMARY OF THE INVENTION

The crampon device according to the present invention provides for interchangeable front picks selected from a variety of standardized, and thus replaceable pick elements. Furthermore, the variety of picks may be augmented as new pick elements are developed, and incorporated in the crampon. Furthermore, the present invention facilitates field replacement and interchange of pick elements by a novel structure which incorPorates a rigid, slightly compressible keystones which transfers and distributes the forces from the shoe to the crampon and the pick. Moreover, the keystones properly and safely retain the crampon picks. Furthermore, the picks may be removed for walking on flat terrain and a blank (no point) crampon pick inserted therein to maintain the structural integrity of the crampon device when the picks are not used.

The crampon device of the present invention further incorporates a novel heel and toe piece, wherein a plurality of teeth, disposed substantially perpendicular to the plane of the shoe sole, are arranged on or to substantially correspond with the faces of a polygonal structure, wherein each face contains at least one tooth.

Adjacent faces are obliquely aligned in a nonperpendicular, nonparallel arrangement. Furthermore, the teeth are substantially oblong, having a thickness and a width greater than the thickness, so that adjacent thickness and width dimensions are arranged in the above-mentioned oblique and nonparallel nonperpendicular manner. Thus, the crampon of the present invention provides greater traction and permits greater accent or decent by the use of such oblong teeth, and the arrangement of the teeth on adjacent, angularly related surfaces, thereby avoiding the skating effect and resulting loss of traction encountered with prior crampon designs.

BRIEF DESCRIPTION OF THE DRAWINGS

These and further features of the present invention will be better understood by reading the following detailed description, taken together with the drawing, wherein:

FIG. 1 is a side elevation of one embodiment of the present invention, as removably attached to a shoe;

FIG. 2 is a plan view of the crampon according to the embodiment of FIG. 1, removed from the shoe;

FIG. 2A is a side elevation of one of the surfaces of the crampon of FIG. 2;

FIGS. 3, 4, 5, 6, 7, 8, 9 and 10 are side views of a variety of mutually interchangeable picks, receivable in the embodiments shown in FIGS. 1 and 2.

DETAILED DESCRIPTION OF THE INVENTION

One embodiment 50 of the crampon according to the present invention incorporates a toe section 52 and a heel section 54, each having a plurality of teeth 56 and 58 respectively. The toe and heel portions 52, 54 are adjustably secured by a connecting element 60 having a reduced vertical dimension 62 having a plurality of regularly spaced holes 64 therein to receive a bolt 82 to secure the heel and toe portions in a substantially rigid manner. Toe and heel retainers 66 and 68 secure the crampon 50 to the sole of shoe 70, wherein the heel retainer 68 engages the upper surface of the heel of the shoe 70 with a heel clamp 72 which is secured to the upper rear portion of the shoe 70 with a strap 74. The toe element retainer 66 engages the shoe 70 above the sole in the recess frequently provided by the shoe manufacturer. The removable and interchangeable picks are shown in positions 90 and 92 protruding from the front surface of the toe section 52 of the crampon 50.

A vertical plan of the crampon 50 is shown in FIG. 2, wherein the toe and heel crampon portion of the crampon 52 and 54 respectively are shown to comprise a flat metal element bent into an octogonal form including adjacent faces 80*a, b, c, d, e, f* and *g*, comprising a majority of a polygon. The heel crampon portion further is formed to include the connecting element 62 having the holes 64 therein regularly spaced for sputive adjustment between the toe and heel crampon portions 52 and 54. The faces 80*a*–80*g* extend downward to form the teeth 58*a* as shown in FIG. 1. Alternative embodiments, not shown, include separately formed teeth attached to selected faces of the toe and/or heel portions 52 and 54.

The toe portion 52 of the crampon 50 comprises a flat metal portion 86 formed to comprise the majority of a octagonal polygon having adjacent sections 86*a, b, c, d, e, f, g, h* and *j* being formed wherein sections 86*b*–86*h* has an average angle of 45° between adjacent faces.

According to one embodiment of the present invention, faces 83c–86g are extended as well as 86a and 86j are formed to provide at least one of the teeth 58, shown in FIG. 1. Furthermore, as shown in FIG. 2A, the surface 86e is formed to include apertures 65 permitting the connecting member 60 to be received therethrough, whereupon it is secured to the front portion 52 metal element 86 by two removable anchoring bolts 82 extending through surfaces 86a, *c*, *g* and *j*.

The removable picks, discussed with relation to FIGS. 3–10 below are removably secured by each bolt 82. When in the pick position 90, the pick is secured between each of the two connecting members 62, and the picks in position 92 are secured against the surfaces 86a and *j* and the keystone elements 88a and 88b. According to one embodiment of the present invention, the picks are removably secured by the bolts 82, wherein the compression forces supplied by the bolts 82 are transferred to the picks 90, 92 through keystone elements 88a and 88b, comprising a partially compressible rigid material are exemplified by thick mylar or similar plastic. Other embodiments of the present invention may comprise keystone elements of greater or lesser comprehensibility and/or rigidity.

The toe retaining element 66 pivotally engages surfaces 86c and *g* of the toe portion 52. The heel retainer 68 similarly pivotally engages the surfaces 80b and *f* of the heel portion 54. Furthermore, according to one embodiment the relationship of the heel retainer 68 to the surfaces 80b and *f* is selectively adjustable by positioning the heel retainer 68 in a pair of opposing holes among a plurality of holes 84. Thus, the crampon adjustment via holes 64 and 84 provides coarse and fine adjustments, respectively, according to one embodiment of the present invention which provides a wider spacing between holes 64 than holes 84. The toe and heel retainer 66 and 68 typically comprise a ⅛ diameter chromolly metal wire, and the other metal elements typically comprise chromolly, stainless steel or other high strength material.

As shown in FIG. 2 the picks in positions 90 and 92 may comprise different picks chosen from among a variety of picks shown in FIGS. 3–10. The pick 100 shown in FIG. 3 comprises a side downward angled toothed pick, typically used in pairs, flanking either pick 110, or 140 discussed below, and comprises a chromolly material 41:40, ⅛ inch thick formed as illustrated in FIG. 3.

The pick 110 illustrated in FIG. 4 comprises an inverted angle toothed pick, used with a pair of picks 100. The pick of FIG. 4 comprises a chromolly 41:40 material, ⅛ inch thick.

The pick 120 shown in FIGS. 5 and 6 comprises a front point, typically inserted in the pick positions 92 together with a blank pick 150 having no protruding point as shown in FIG. 10 in the center position, 90 of FIG. 2. Pick 120 typically comprises a chromolly 41:40 material ⅛ inch thick and has a slight (≈3°) downward inclination.

A tooth downward claw pick 130 shown in FIG. 7 is typically used pick positions 92 and a blank pick 150, of FIG. 10 is used in the middle position, 90. Typically, the tooth downward claw pick 130 of FIG. 7 comprises a chromolly 41:40 material, ⅛ inch thick.

A novel tubular pick 140, wherein one embodiment is illustrated in FIGS. 8 and 9, shows a ¾ inch diameter tubular pick occupying the center position 90, and typically used in conjunction with a pair of downward picks of FIG. 3 used in the side position 92. The tubular pick of FIG. 10 comprises a tubular front section 142 wherein an aperture 144 extends rearward along the section 142 and is connected to a rear portion 146 by a transitional region 148 wherein the aperture 144 broadens to accommodate the flat shape of the connecting portion 146 and provide a transition of forces to minimize a concentration of force at any portion therealong. Other embodiments of picks 140 substantially eliminates the forward section 142 (combining it within the transitional region 148) or includes serrations 143 along the edge of the aperture 144, wherein the aperture 144 gradually widens toward the rearward section beginning at the front of the pick.

Modifications and substitutions of the elements and structures of the present invention made by one of ordinary skill in the art are considered to be within the scope of the present invention which has not been modified except as follows.

What is claimed is:

1. A crampon removably affixed to a shoe for providing enhanced traction, comprising:

a sole section and a heel section, wherein each section comprises a plurality of teeth dimensioned by a thickness and a width greater than said thickness;

substantially rigid means for retaining said sole section and said heel section in relation to the sole and the heel of said shoe, respectively in a generally outward manner therefrom, said plurality of teeth being further disposed to provide a substantially noncolinear arrangement of said teeth; and means for removably affixing said substantially rigid means for retaining to said shoe.

2. The crampon of claim 1 wherein said means for retaining provides a plurality of surfaces corresponding to the position of at least one of said teeth wherein adjacent ones of said plurality of surfaces form a nonperpendicular angle therebetween, and contiguous ones of said plurality of surfaces form a majority of a polygon.

3. The crampon of claim 2, wherein said adjacent surfaces comprise at least seven surfaces having an average angle of 45° adjacent surfaces, and said polygon comprises an octagon.

4. The crampon of claim 2, wherein said means for retaining includes a toe portion and a heel portion, said crampon further including adjustable means or connecting said toe portion and said heel portion.

5. The crampon of claim 1, wherein said means for retaining includes a toe portion which further includes means for removably securing a plurality of picks.

6. A crampon comprising:

a toe portion having a continuous peripheral portion comprising the majority of a polygon having at least one tooth on the surfaces forming the majority of a polygon;

a heel portion having a continuous peripheral portion comprising a plurality of surfaces including at least one tooth thereon, wherein said surfaces form a majority of a polygon; means for connecting said toe portion and said heel portion; and means for removably securing said toe and said heel portion to a shoe.

7. The crampon of claim 6, wherein said means for connecting comprises means for adjustably connecting said toe portion and said heel portion providing a selectable distance therebetween.

8. The crampon of claim 7, wherein said means for adjustably connecting comprises a rigid member.

9. The crampon of claim 6, wherein at least one of said toe portion and said heel portion comprises an octagon.

10. The crampon of claim 6, further comprising means for receiving a plurality of picks.

11. A crampon, comprising:

a formed member having a plurality of nonparallel, nonorthogonal adjacent portions forming a majority of a polygon;

a plurality of teeth, wherein at least one tooth is associated with the portions of said formed member forming said majority of a polygon; and means for securing said formed member to a shoe.

12. The crampon of claim 11, wherein said polygon comprises an octagon.

13. A crampon, comprising:

a formed member comprising:

a plurality of surfaces;

at least one substantially planar tooth associated with each of a plurality of said surfaces, wherein the majority of teeth are obliquely disposed relative to adjacent teeth.

14. The crampon of claim 13, wherein adjacent of said teeth are disposed at an average angle of 45° between adjacent teeth.

15. The crampon of claim 13, further comprising means for removably securing said formed member to a shoe.

16. A crampon comprising:

a plurality of picks; and a formed member having a plurality of teeth extending substantially perpendicular from the plane of said formed member, further including means for removably securing said plurality of picks therein extending transversely through said plurality of picks in the plane of said formed member and being removable at the periphery of said formed member.

17. The crampon of claim 16, wherein said means for removably securing applies a compression force in the plane of said formed member, said crampon further comprising:

means disposed within said formed member for applying said compression force across said formed member and said removably secured plurality of picks therein.

18. The crampon of claim 16, wherein said plurality of picks comprises at least one of a double flat pick, a single reverse angle pick, a flanker pick, a tubular pick and a toothed claw pick.

19. A tubular pick comprising:

a substantially flat rear portion for securing to a crampon; and a tubular front portion to engage the climbing surface, having an aperture extending axially along the tubular surface of said tubular front portion; and a transitional portion interposed between said tubular front portion and said rear portion wherein said aperture is varied to structurally accommodate said tubular front portion and said rear portion.

20. The tubular pick of claim 19, wherein the dimensions of said tubular front portion aperture increases as the distance from the front of said tubular front portions increases.

* * * * *